US005699958A

United States Patent [19]

Kohler

[11] Patent Number: 5,699,958

[45] Date of Patent: Dec. 23, 1997

[54] CARTON FLAP RETENTION ARRANGEMENT

[75] Inventor: Karl Kohler, Bartlett, Ill.

[73] Assignee: Jefferson Smurfit Corporation, Clayton, Mo.

[21] Appl. No.: 714,597

[22] Filed: Sep. 16, 1996

[51] Int. Cl.[6] ..... B65D 5/49

[52] U.S. Cl. ..... 229/120.37; 229/23 BT; 229/125; 229/930

[58] Field of Search ..... 229/23 R, 23 A, 229/23 BT, 125, 120.37, 145, 146, 930

[56] References Cited

U.S. PATENT DOCUMENTS

| | | | |
|---|---|---|---|
| 2,216,299 | 10/1940 | Schilling | 229/132 |
| 2,577,248 | 12/1951 | James | 229/23 R |
| 2,727,677 | 12/1955 | Zastrow | 229/120.37 |
| 3,185,379 | 5/1965 | Kohlhaas | 229/120.37 |
| 3,276,658 | 10/1966 | Locke | 229/23 BT |
| 3,365,109 | 1/1968 | Kessler et al. | 229/125 |
| 3,433,402 | 3/1969 | Persson | 229/146 |
| 4,887,766 | 12/1989 | Schoeneweis | 229/125 |
| 5,148,940 | 9/1992 | Mendise | 229/125 |

FOREIGN PATENT DOCUMENTS

| | | | |
|---|---|---|---|
| 571145 | 2/1959 | Canada | 229/120.37 |
| 323329 | 4/1970 | Switzerland | 229/146 |

*Primary Examiner*—Gary E. Elkins
*Attorney, Agent, or Firm*—Richard W. Carpenter

[57] ABSTRACT

The combination of a pair of paperboard carton members positioned in a paperboard tray member, wherein the carton members have projections extending from the bottom wall thereof through related openings in adjacent walls of the tray member, and wherein at least one of the members includes means for temporarily holding the carton closure flaps in a generally vertical open position against the carton end wall panels while the cartons are being filled on a packaging line.

20 Claims, 4 Drawing Sheets

FIG. 6
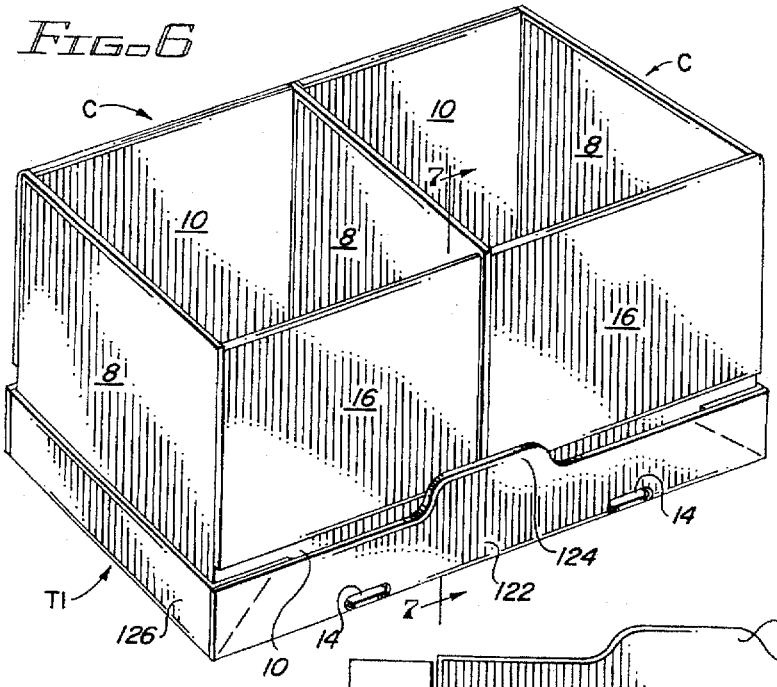
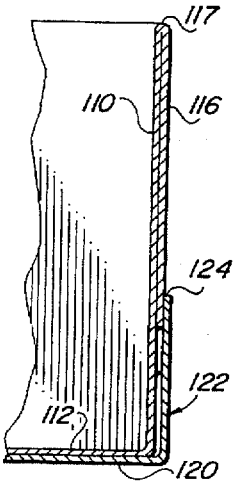
FIG. 7
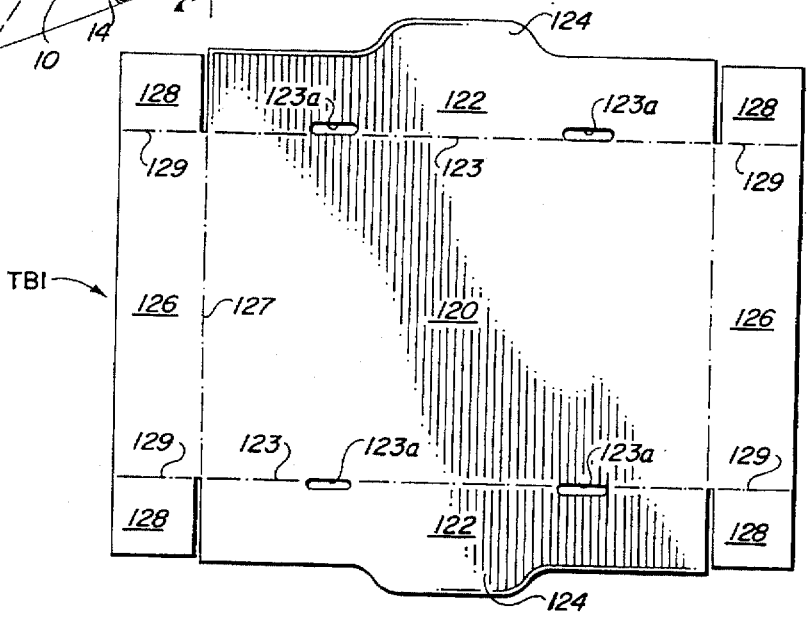
FIG. 8
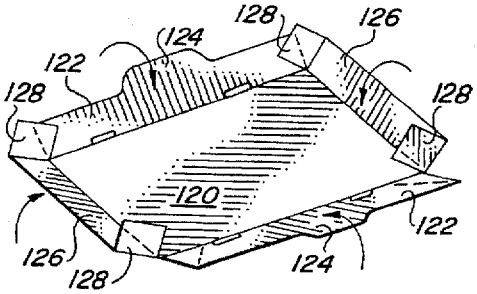
FIG. 9
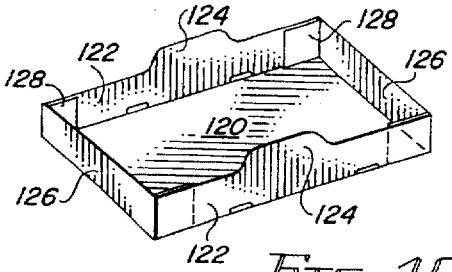
FIG. 10

CARTON FLAP RETENTION ARRANGEMENT

BACKGROUND OF THE INVENTION

1. Field of the Invention

This invention relates to containers such as paperboard cartons, and more particularly to arrangements for temporarily holding carton upper closure flaps in a vertical open position, so the cartons can be filled while they are being carried in trays on a conveyor of a packaging line.

2. Description of the Background Art

A background art search directed to the subject matter of this invention conducted in the United States Patent and Trademark Office disclosed the following United States Letters Patent:

| | | | |
|---|---|---|---|
| 1,063,845 | 1,132,292 | 1,482,857 | 2,216,299 |
| 2,588,455 | 2,690,285 | 2,965,279 | 2,990,995 |
| 3,330,466 | 3,365,109 | 3,369,652 | 3,572,577 |
| 3,940,053 | 4,134,533 | 4,356,952 | 4,372,476 |
| UK 783,932 | UK 2,118,147A | GER 2,034,825 | GER 2,106,357 |
| FR 1,409,752 | IT 541,920 | EP 0 588 751 A1 | |

None of the patents uncovered in the search discloses the combination of a pair of paperboard carton members positioned in a paperboard tray member, wherein the carton members have projections extending from the bottom wall thereof through related openings in adjacent walls of the tray member, and wherein at least one of the members includes means for temporarily holding the carton closure flaps in a generally vertical open position against the carton end wall panels while the cartons are being filled on a packaging line.

SUMMARY OF THE INVENTION

It is a primary object of the invention to provide an improved arrangement for holding the upper closure flaps of cartons in a vertical open position to facilitate filling of the cartons as they are being carried along in trays on a conveyor of a packaging line.

Another object of the invention is the provision of an arrangement for holding carton closure flaps in an open position, as the cartons are being carried in trays along a conveyor of a packaging line, which arrangement utilizes the engagement between the ends of the carton flaps and projections extending upwardly from side wall panels of the trays.

Yet another object of the invention is to provide an arrangement for holding carton closure flaps in an open position, as the cartons are being carried in trays along a conveyor of a packaging line, which arrangement utilizes a novel carton structure wherein the carton end walls and the carton closure flaps are so formed and folded that the flaps can be maintained in an open position without engagement with side wall panels of the trays.

These and other objects of the invention will be apparent from an examination of the following description and drawings.

BRIEF DESCRIPTION OF THE DRAWINGS

FIGS. 6–10 are views similar to those of FIGS. 1–5, but illustrate a modified form of the invention.

It will be understood that, for purposes of clarity, certain elements may have been omitted from certain views where they are believed to be illustrated to better advantage in other views.

DESCRIPTION OF THE PREFERRED EMBODIMENT

Figure 3:
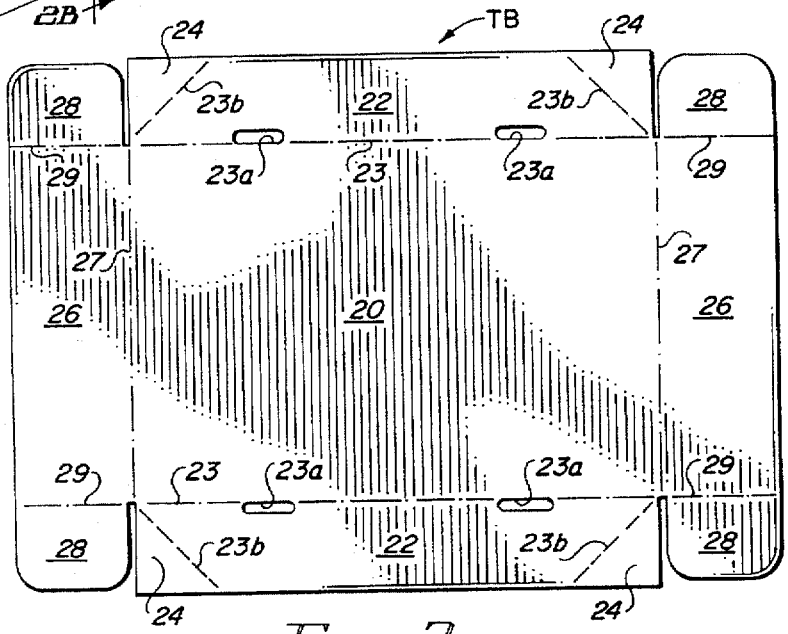
FIG. 3 is a plan view of a blank of foldable sheet material from which the tray illustrated in the other views may be formed.

Referring now to the drawings for a better understanding of the invention, it will be seen that a pair of cartons C are shown positioned in a tray T which may be formed from the blank TB of paperboard illustrated in FIG. 3.

Each of the cartons C includes an opposed pair of side wall panels 8 and an opposed pair of end wall panels 10 foldably joined to and extending between the respective side wall panels.

Figure 17:
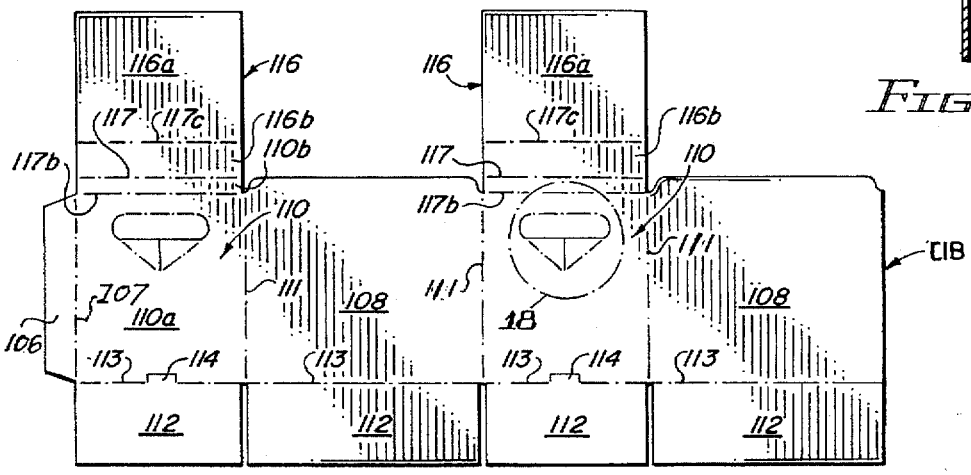
FIG. 17 is a plan view of a blank of foldable sheet material from which the carton illustrated in FIG. 16 may be formed.

The bottom of each carton is closed by bottom closure flaps 12, which are foldably joined to lower edges of the carton side and end wall panels in the same manner as are the bottom closure flaps of the embodiment of the carton illustrated in FIG. 17.

Figure 2A:
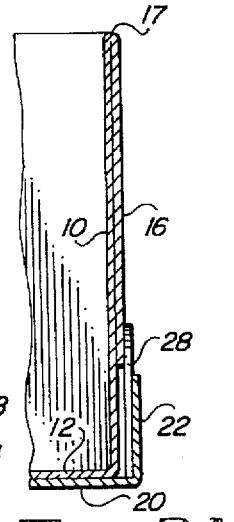
FIGS. 2A and 2B are vertical sectional views taken on lines 2A and 2B of FIG. 1, respectively.

The upper end of the carton may be closed by a pair of upper closure flaps 16 foldably joined on fold lines 17 to upper ends of end wall panels 10, and the primary feature of the invention is to provide means for holding the carton upper closure flaps 16 in an open position, as shown in FIG. 2, so the flaps will not be in the way during the filling operation.

Figure 4:
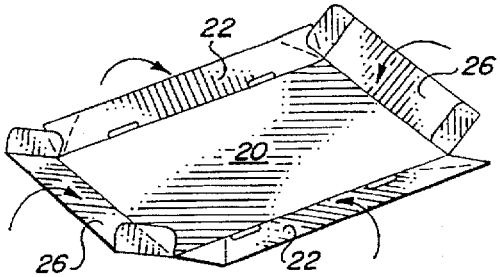
FIGS. 4 and 5 are isometric views showing the manner in which the tray illustrated in FIG. 1 is formed from the blank illustrated in FIG. 3.
Figure 5:
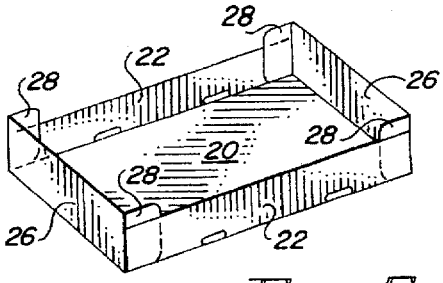
Figure 11:
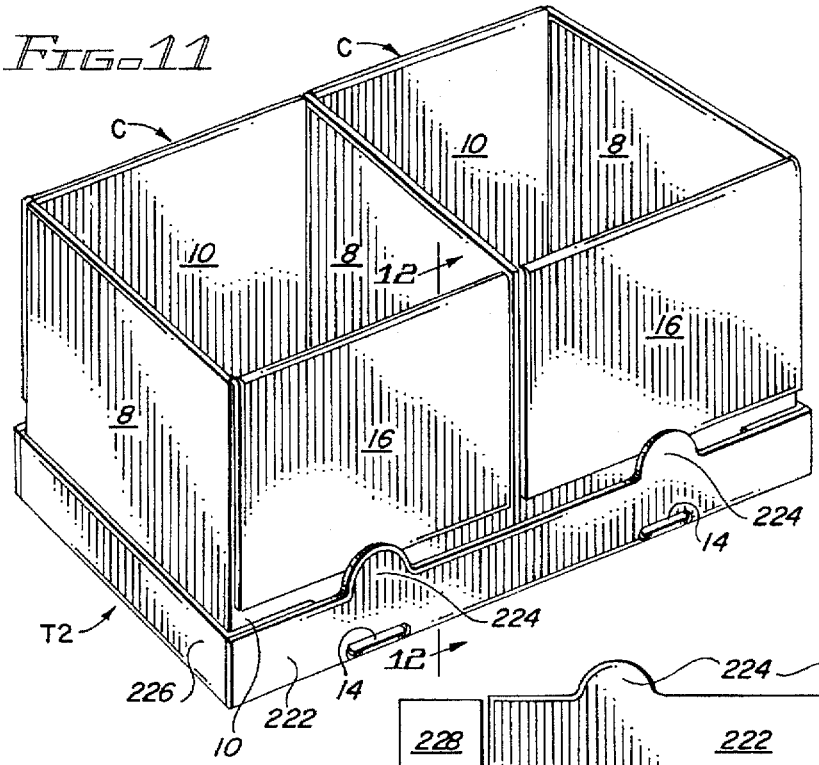
FIGS. 11–15 are views similar to those of FIGS. 6–10, but illustrate another modified form of the invention.
Figure 12:
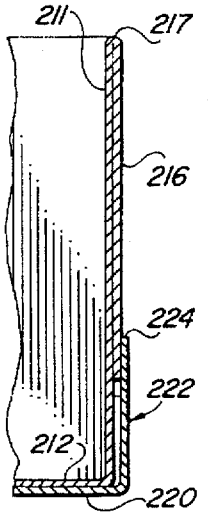
Figure 13:
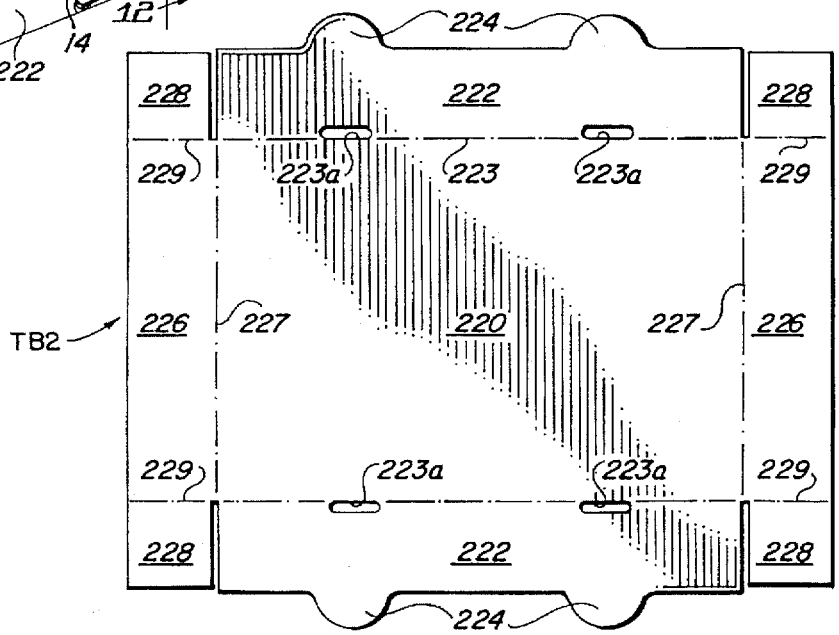
Figure 14:
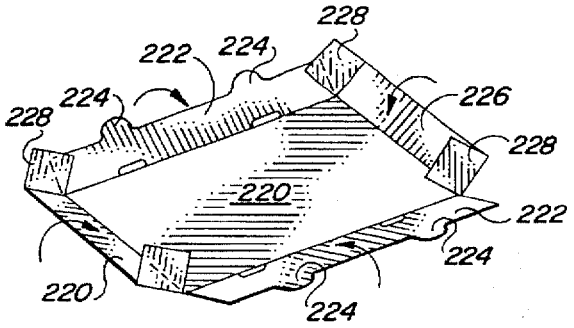
Figure 15:
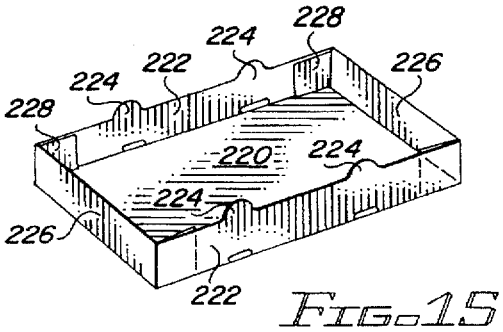

As best seen in FIGS. 3–5, Tray T includes a bottom wall panel 20 having opposed pairs of side wall panels 22 and end wall panels 26 foldably joined to opposed side and end edges thereof along fold lines 23 and 27, respectively, and upstanding therefrom. Side wall panels 22 have extending therethrough openings in the form of slots **23*a* located adjacent fold lines 23** which join the side wall panels to the bottom wall panel.

Figure 1:
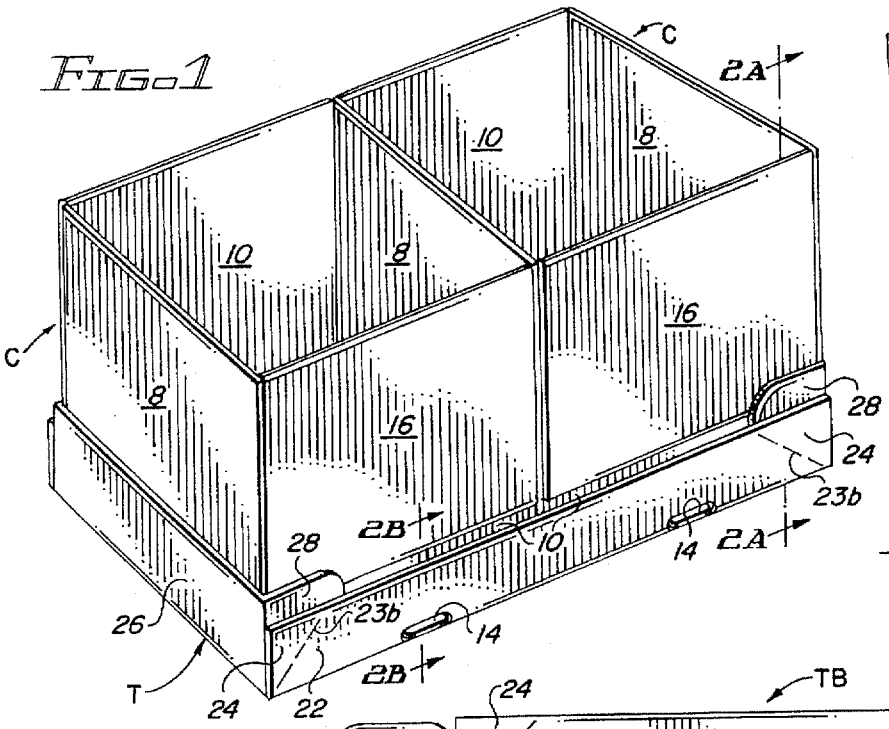
FIG. 1 is an isometric view of a pair of cartons positioned within a tray embodying features of the present invention.
Figure 2B:
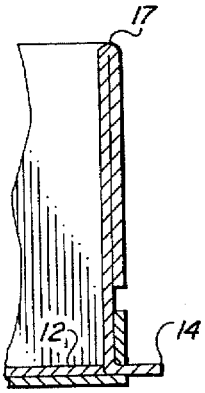

As best seen in FIGS. 1 and 2B, the function of the tray side wall panel openings **23*a* is to receive portions of tabs 14** which project outwardly from the carton bottom wall flaps that are joined to the carton end wall panels. This engagement helps maintain the cartons in the proper location within the tray.

Side wall panels 22 are also provided near their ends with diagonal fold lines **23*b* which form triangular sections 24**.

The tray end wall panels 26 are connected to the side wall panels 22 by means of corner flaps 28 which are foldably joined to opposite ends of each end wall panel 26 along a fold line 29. Corner flaps 28 may be adhesively secured to adjacent side wall panel triangular sections 24.

As best seen in FIGS. 1, 2, and 5, because corner flaps 28 are wider than side wall panels 22, they project upwardly beyond the upper edges of the side wall panels and serve to engage the lower end portions of the carton upper closure flaps 16 and thereby retain them in a vertical open position against the related end wall panels 10 of the cartons. Thus, the closure flaps may be kept out of the way when the cartons are being filled.

Turning now to FIGS. 6–10 it will be seen that a slightly modified form of the invention is shown. The cartons C shown in these Figures have the same structure as the cartons illustrated in FIG. 1, but the tray T1 is different from the tray T shown in the earlier described views. In all of the views elements of a structure corresponding to those of another structure have been identified by similar or related numerals.

In Tray T1 the side wall panels 122 have centrally located projections 124 extending upwardly therefrom for engagement with portions of the upper closure flaps of both of the two cartons in the tray to hold the closure flaps in an open position.

Turning now to FIGS. 11–15 it will be seen that a slightly modified form of the invention is shown. The cartons C shown in these Figures have the same structure as the cartons illustrated in FIG. 1, but the tray T1 is different from the tray T shown in the earlier described views. In all of the views elements of a structure corresponding to those of another structure have been identified by similar or related numerals.

In Tray T2 the side wall panels 222 each have a pair of laterally spaced projections 224 extending upwardly therefrom for engagement with portions of the upper closure flaps of both of the two cartons in the tray to hold the closure flaps in an open position.

Now turning to FIGS. 16–19C, it will be seen that yet another embodiment of the invention is illustrated.

In this embodiment, although a pair of cartons C1 are carried in a tray T3, the tray side and end wall panels 322 and 326 are of equal height with no projections extending upwardly therefrom for contact with the carton closure flaps. Instead this embodiment of the invention depends on the construction of the cartons to maintain the closure flaps in an open position without the need to rely on contact between the carton closure flaps and projections on the tray side wall panels.

Figure 16:
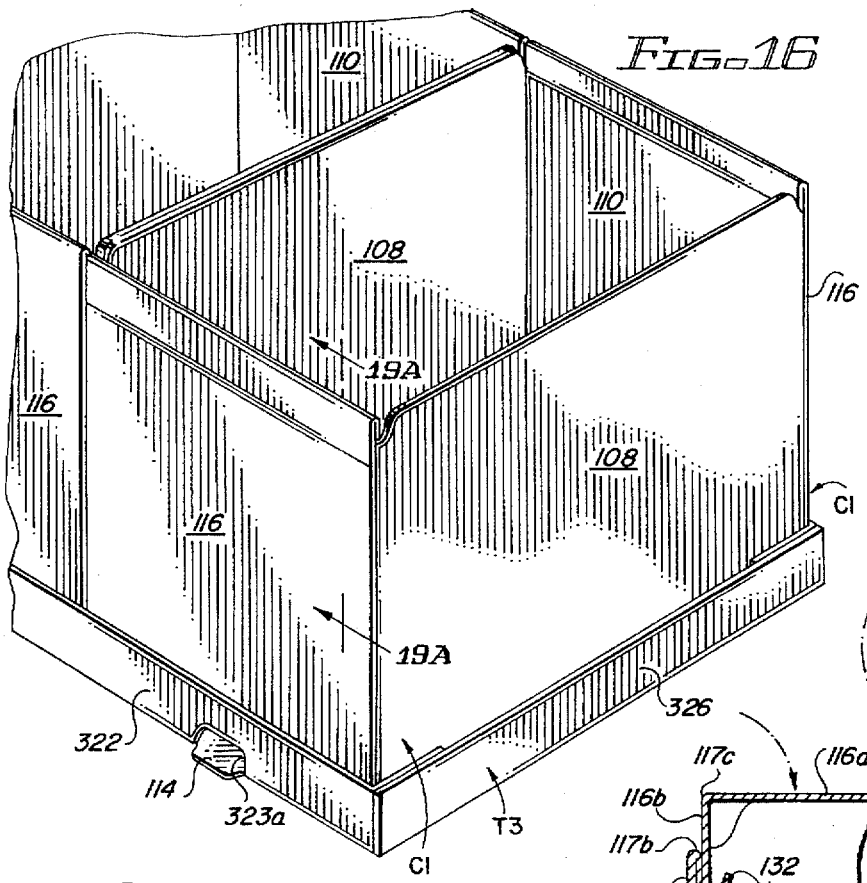
FIG. 16 is an isometric view of one carton and a portion of another carton in a tray embodying another form of the invention.

Carton C1, illustrated in FIG. 16, may be formed from the blank C1B illustrated in FIG. 17. The carton body includes opposed pairs of side and end wall panels 108 and 110 foldably joined to each other along parallel fold lines 111, as well as a glue flap 106 foldably joined to an end wall panel on a fold line 107.

Bottom closure flaps 112 are foldably joined to the lower edges of the side and end wall panels along fold lines 113. As previously mentioned, the bottom closure flaps joined to the end wall panels 110 each have a projection 114 extending therefrom for engagement with related openings in the tray side wall panels 322.

Closure of the upper end of the carton is accomplished by a pair of upper closure flaps 116 foldably joined to the upper portions of the carton end wall panels 110, as hereinafter described.

As best seen in FIGS. 15, 17, and 19A–19D, each carton end wall panel 110 includes a major portion 110*a* and a minor portion 110*b* foldably joined to minor portion 110*a* on a fold line 117*b*.

Also each upper closure flap 116 includes a major portion 116*a* and a minor portion 116*b* foldably joined to major portion 116*a* on a fold line 117*c*.

Referring now to FIGS. 19A–19D, it will be seen that the minor portion 110*b* of each end wall panel 110 is adhesively secured to minor portion 116*b* of the related upper closure flap 116, and is foldably joined thereto along a fold line 117.

In a conventional carton closure flap folding arrangement the fold between the upper edge of the carton side or end wall and the closure flap normally creates a spring-like action that tends to prevent the closure flap from lying against the carton side or end wall.

However, in the present invention, the spring-like action is eliminated, by the relationship between that closure flaps 116 and the end walls 110, so the closure flaps are free to remain in a vertical open position as seen in FIG. 16. Thus no additional hold down means, such as contact with the tray side wall projections, are required.

Figure 19A:
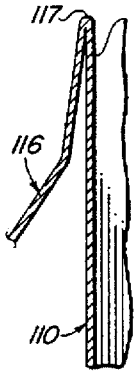
FIG. 19A is a vertical sectional view taken on line 19A—19A of FIG. 16.
Figure 19B:
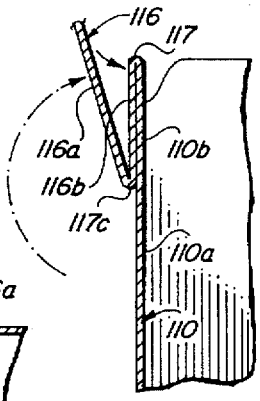
FIGS. 19B, 19C, and 19D are views similar to that of FIG. 19A but illustrate several steps in the carton forming operation.
Figure 19D:
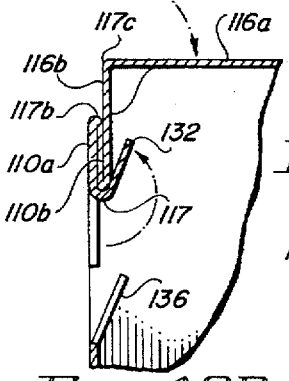
Figure 19C:
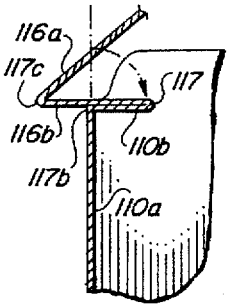
Figure 18:
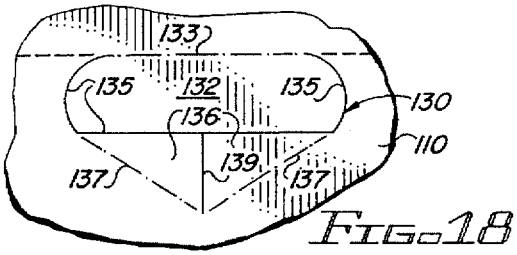
FIG. 18 is an enlarged view of a portion of the structure illustrated in FIG. 17.

After the cartons have passed along the conveyor filling line and have been filled, the upper closure flaps may be folded over to the position illustrated best in FIG. 19D with the minor portions of the closure flap and the carton end wall lying against the inner surface of the carton end wall major portion, and with the major portion of the closure flap extending inwardly therefrom in a horizontal plane.

Again referring to FIGS. 17, 18, and 19D, it will be seen that the carton end walls 110 may each be provided with a handle structure indicated generally at 130 which includes a handle flap 132 which is defined by a fold line 133 joining the flap to the carton end wall and by a cut line 135.

In order to facilitate access to the handle flap 132, end wall 110 includes a pair of triangular entry tabs 136 located adjacent and immediately below the handle flap and which are defined by a pair of diagonally extending fold lines 137 and a vertical cut line 139 therebetween.

In order to lift the carton by the handles, the entry tabs are depressed, as shown in FIG. 19D, so the handle flap can be grasped and pushed into the carton and folded against the inner surface of the closure flap minor portion. Thus, a strong four-ply handle is created.

Thus it should be understood that the invention provides different ways to maintain carton closure flaps in a vertical open position, so the cartons can be filled as the cartons are carried in trays on a conveyor of a packaging line.

What is claimed is:

1. A combination of a pair of carton members and one tray member adapted to hold the carton members in place on a packaging line conveyor while the carton members are being filled, said carton and tray members each being formed from a unitary sheet of foldable sheet material, such as paperboard, comprising:

(a) said tray member including a generally rectangular bottom wall with opposed pairs of side and end wall panels foldably joined to each other and to opposed side and end edges of said bottom wall and upstanding therefrom;

(b) said carton members each including:

(i) a bottom wall with opposed pairs of side and end wall panels foldably joined to each other and to opposed side and end edges of said bottom wall and upstanding therefrom;

(ii) a pair of upper closure flaps foldably joined to upper portions of said carton end wall panels;

(c) each of said carton members having substantially the same length as the width of said tray member to allow said carton members to be positioned side by side in said tray member with said carton member end wall panels abutting said tray member side wall panels and with one side wall panel of each of said carton members abutting an adjacent one of said tray member end wall panels;

(d) one of said members including means for maintaining said carton member upper closure flaps in an open position against said carton side wall panels while said carton is being filled.

2. A combination according to claim 1, wherein said tray member includes means for maintaining said carton member upper closure flaps in a vertical open position against said carton side wall panels while said carton is being filled.

3. A combination according to claim 2, wherein said tray member includes corner flaps foldably interconnecting said tray member side and end wall panels and having upper marginal portions disposed to extend above said side and end wall panels for engagement with marginal portions of said carton upper closure flaps for maintaining said carton flaps in an open position.

4. A combination according to claim 2, wherein said tray member side wall panels each include a single projection extending upwardly therefrom for engagement with marginal portions of upper closure flaps of two of said cartons for maintaining said carton flaps in an open position.

5. A combination according to claim 2, wherein said tray member side wall panels each include a pair of laterally spaced projections extending upwardly therefrom for engagement with marginal portions of upper closure flaps of two of said cartons for maintaining said carton flaps in an open position.

6. A combination according to claim 1, wherein each of said carton members includes a bottom closure flap having a projection extending laterally therefrom for engagement within a related opening in an adjacent side wall panel of said tray member.

7. A combination according to claim 1, wherein said carton members include means for maintaining said carton member upper closure flaps in a vertical open position against a related of said tray member end wall panels without the need for engagement between said carton member closure flaps and any of said tray member side wall panels.

8. A combination of a pair of carton members and one tray member adapted to hold the carton members in place on a packaging line conveyor while the carton members are being filled, said carton and tray members each being formed from a unitary sheet of foldable sheet material, such as paperboard, comprising:

(a) said tray member including a generally rectangular bottom wall with opposed pairs of side and end wall panels foldably joined to each other and to opposed side and end edges of said bottom wall and upstanding therefrom;

(b) said carton members each including:

(i) a bottom wall with opposed pairs of side and end wall panels foldably joined to each other and to opposed side and end edges of said bottom wall and upstanding therefrom;

(ii) a pair of upper closure flaps foldably joined to upper portions of said carton end wall panels;

(c) each of said carton members having substantially the same length as the width of said tray member to allow said carton members to be positioned side by side in said tray member with said carton member end wall panels abutting said tray member side wall panels and with one side wall panel of each of said carton members abutting an adjacent one of said tray member end wall panels;

(d) certain of said tray member side wall panels including upwardly extending retaining tabs arranged and disposed to engage said carton member upper closure flaps and maintain them in an open vertical position against said carton side wall panels while said carton is being filled.

9. A combination according to claim 8, wherein certain of said tray member side wall panels include a single projection extending upwardly therefrom for engagement with marginal portions of upper closure flaps of two of said cartons for maintaining said carton flaps in an open position.

10. A combination according to claim 8, wherein certain of said tray member side wall panels include a pair of laterally spaced projections extending upwardly therefrom for engagement with marginal portions of upper closure flaps of two of said cartons for maintaining said carton flaps in an open position.

11. A combination of a pair of carton members and one tray member adapted to hold the carton members in place on a packaging line conveyor while the carton members are being filled, said carton and tray members each being formed from a unitary sheet of foldable sheet material, such as paperboard, comprising:

(a) said tray member including a generally rectangular bottom wall with opposed pairs of side and end wall panels foldably joined to each other and to opposed side and end edges of said bottom wall and upstanding therefrom;

(b) said carton members each including:

(i) a bottom wall with opposed pairs of side and end panels foldably joined to each other and to opposed side and end edges of said bottom wall and upstanding therefrom;

(ii) a pair of upper closure flaps foldably joined to upper portions of said carton end wall panels;

(c) each of said carton members having substantially the same length as the width of said tray member to allow said carton members to be positioned side by side in said tray member with said carton member end wall panels abutting said tray member side wall panels and with one side wall panel of each of said carton members abutting an adjacent one of said tray member end wall panels;

(d) each of said carton member end wall panels including an upper marginal portion having a lower edge foldably joined to an upper edge of a remaining portion of said end wall panel and having an upper edge foldably joined to an outer edge of an outer marginal portion of a related one of said upper closure flaps;

(e) said related upper closure flap marginal portion having an inner edge foldable joined to a remaining portion of said upper closure flap and having an outer surface adhesively secured to an outer surface of said end wall panel marginal portion, whereby said upper closure flap will remain in an open position against said side wall panel while said carton is being filled.

12. A combination according to claim 11, wherein each of said carton members includes a bottom closure flap having a projection extending laterally therefrom for engagement within a related opening in an adjacent side wall panel of said tray member.

13. A combination according to claim 11, wherein when one of said carton member upper closure flaps is in an open position, both of said closure flap major and minor portions are disposed to lie against outer surfaces of both major and minor portions of an adjacent of said carton member end wall panel.

14. A combination according to claim 11, wherein when one of said carton member upper closure flaps is in a closed position, said closure flap minor portion and said end wall panel minor portion are both positioned against an inner surface of said end wall panel major portion, and said closure flap major portion is disposed to extend horizontally inwardly from said closure flap minor portion.

15. A combination according to claim 11, wherein each of said carton member end wall panels includes a handle panel formed from material of said end wall panel and foldably joined thereto, and wherein said handle panel is arranged and disposed to be folded 180 degrees into said carton member whereby a related one of said end wall panel minor portion and a related one of said upper closure flap minor portion will be interposed between said handle panel and said end wall panel major portion.

16. A unitary blank of foldable sheet material, such as paperboard, for use in forming a carton with upper closure flaps adapted to remain in open position when said carton is being filled on a packaging line, said blank being cut and scored to provide:

(a) a first end wall panel, a first side wall panel, a second end wall panel, and a second side wall panel foldably joined to each other on parallel fold lines;

(b) bottom closure flaps foldably joined to lower edges of each of said end and side wall panels;

(c) upper closure flaps foldably joined to upper edge of said end wall panels;

(d) each of said end and side wall panels having substantially the same height dimension between said upper and lower closure flaps;

(e) each of said end wall panels including a relatively narrow minor portion and a substantially larger major portion foldably joined to each other on a fold line extending parallel to fold lines joining said closure flaps to said end wall panels;

(f) each of said upper closure flaps including a relatively narrow minor portion and a substantially larger major portion foldably joined to each other on a fold line extending parallel to fold lines joining said closure flaps to said end wall panels;

(g) each of said end wall panel minor portions being foldably joined to an adjacent one of said upper closure flap minor portions on a fold line extending parallel to fold lines joining said closure flaps to said end wall panels.

17. A blank according to claim 16, wherein certain of said bottom closure flaps have extending therefrom projections adapted to be received within complementary openings of a side wall panel of a tray holding a carton erected from said blank.

18. A blank according to claim 17, wherein said projections extend from said bottom closure flaps that are foldably joined to said carton end wall panels.

19. A blank according to claim 16, wherein each of said carton end wall panels includes a handle panel cut from material of said end wall panel and foldably joined thereto.

20. A blank according to claim 19, wherein each of said carton end wall panels includes a pair of triangular entry panels located adjacent said handle panel, foldably joined to said end wall panel, and arranged and disposed to be pushed into a carton erected from said blank to provide access to said handle panel.

* * * * *